US005649696A

United States Patent [19]

Yamada

[11] Patent Number: 5,649,696

[45] Date of Patent: Jul. 22, 1997

[54] BILL RECEIVER

[75] Inventor: Yoshihiro Yamada, Gifu-ken, Japan

[73] Assignee: Tokai Riken Co., Ltd., Mugi-gun, Japan

[21] Appl. No.: 653,720

[22] Filed: May 23, 1996

[30] Foreign Application Priority Data

May 26, 1995 [JP] Japan ..... 7-128363
May 10, 1996 [JP] Japan ..... 8-115921

[51] Int. Cl.[6] ..... B65H 5/22

[52] U.S. Cl. ..... 271/3.14; 271/273; 271/275; 271/186; 271/314; 271/207

[58] Field of Search ..... 271/3.21, 3.14, 271/3.24, 225, 240, 272, 273, 275, 186, 314, 207; 194/206, 207

[56] References Cited

U.S. PATENT DOCUMENTS 4,720,092 1/1988 Juleff ..... 271/207
5,203,217 4/1993 Buckley ..... 271/273
5,419,423 5/1995 Istida et al. ..... 194/207
5,533,605 7/1996 Mays et al. ..... 194/206

FOREIGN PATENT DOCUMENTS 0169619 10/1983 Japan ..... 271/225
2154557 9/1985 United Kingdom ..... 271/207

*Primary Examiner*—H. Grant Skaggs
*Attorney, Agent, or Firm*—Armstrong, Westerman, Hattori, McLeland & Naughton

[57] ABSTRACT

A bill receiver has a casing 11 having a guide groove 16 on and along which a bill is put on. A cover handle 31 is operated into a totally closed state to transfer the bill through a speed increasing gear unit 40 and a carrying roller unit 50, thereby piling up the bills on a base 21 fixed on the casing 11.

9 Claims, 10 Drawing Sheets

BILL RECEIVER

BACKGROUND OF THE INVENTION

1. Field of the Invention

This invention relates to a bill receiver which is fixed in a drawer of a register or at the outside of the drawer. For example, it receives a Japanese ten thousand yen bill which is a maximum price bill now in Japan and safely keeps the bills so as to make it difficult to move. It relates to a bill receiver which is effective for security in particular. Of course, it can be used for a variety of kinds of bills such as a five thousand yen bill, a one thousand yen bill, other nations bills and so on.

2. Description of Related Art

Conventionally, a register is provided at an accounting section of shops or stores for recording receipts and disbursements. A drawer thereof has divisions according to sizes and shapes of moneys. The divisions can receive the moneys properly while classifying them. A maximum price bill once received does not need to taken out therefrom as change. In view of crime prevention, it is not preferable to keep the maximum price bills with other moneys in the drawer of the register.

In view of the above, it is possible to provide a container with a key lock at a concealed place and so on under the register so that only the bills are kept therein.

However, such a container needs to be set at a place usually invisible. Therefore, it will take much time to put a bill therein and much labor to handle it. As a result, it will be rarely used and impractical.

SUMMARY OF THE INVENTION

An object of the invention is to provide a bill receiver which can be small sized so as to be fittable in a drawer of a register and which can be easily handled for storing bills.

According to one preferred mode of the invention, a bill receiver comprises a casing defining a container box for receiving and storing bills. A guide is provided on an upper surface of the casing and guiding lateral edges of the bill. A cover is provided on the upper surface of the casing so as to open and close the upper surface of the casing. A transferring means carries the bill on the guide inside the container box in synchronous with an operation of the cover from an open state to a closed state.

According to another preferred mode of the invention, a bill receiver comprises a box made of outer walls for receiving and storing bills. The box includes a base defining one part of the outer walls at least at a bottom of the box, and a casing defining other part of the outer walls than the base, while containing a top of the outer walls. A key part secures the casing on a predetermined fixed part. A guide is provided on the top surface of the casing and guiding lateral edges of the bill. A cover is provided on the top surface of the casing so as to open and close the top surface of the casing. A transferring means carries the bill on the guide inside the box in synchronous with an operation of the cover from an open state to a closed state.

Further objects and advantages of the invention will be apparent from the following description, reference being had to the accompanying drawings, wherein preferred embodiments of the invention are clearly shown.

DESCRIPTION OF THE PREFERRED EMBODIMENTS

Figure 1:
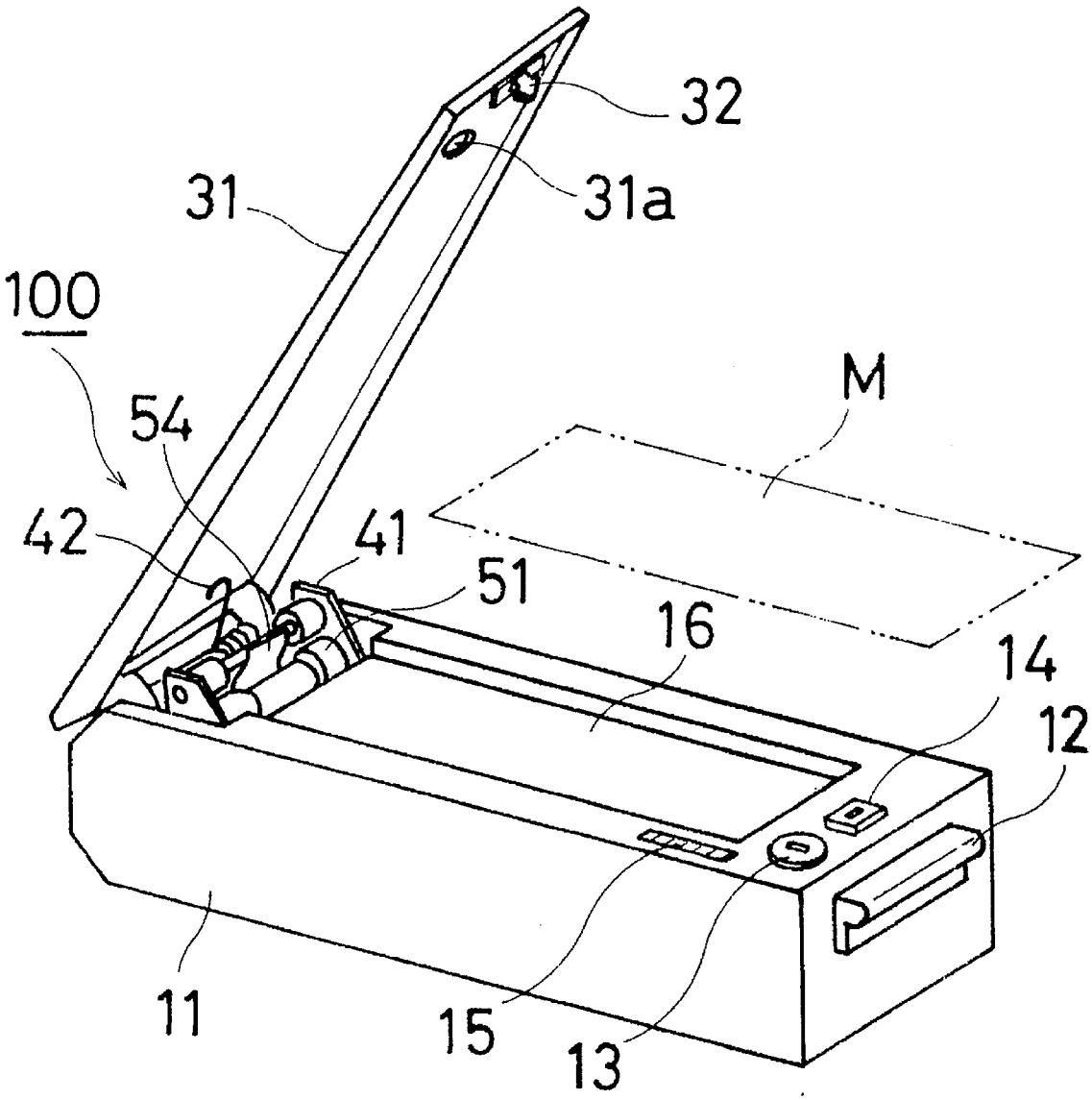
FIG. 1 is a perspective view showing a full open state of a cover handle of a bill receiver according to a first embodiment of the invention.

Preferred embodiments of the invention will be described hereafter referring to the drawings.

Figure 2:
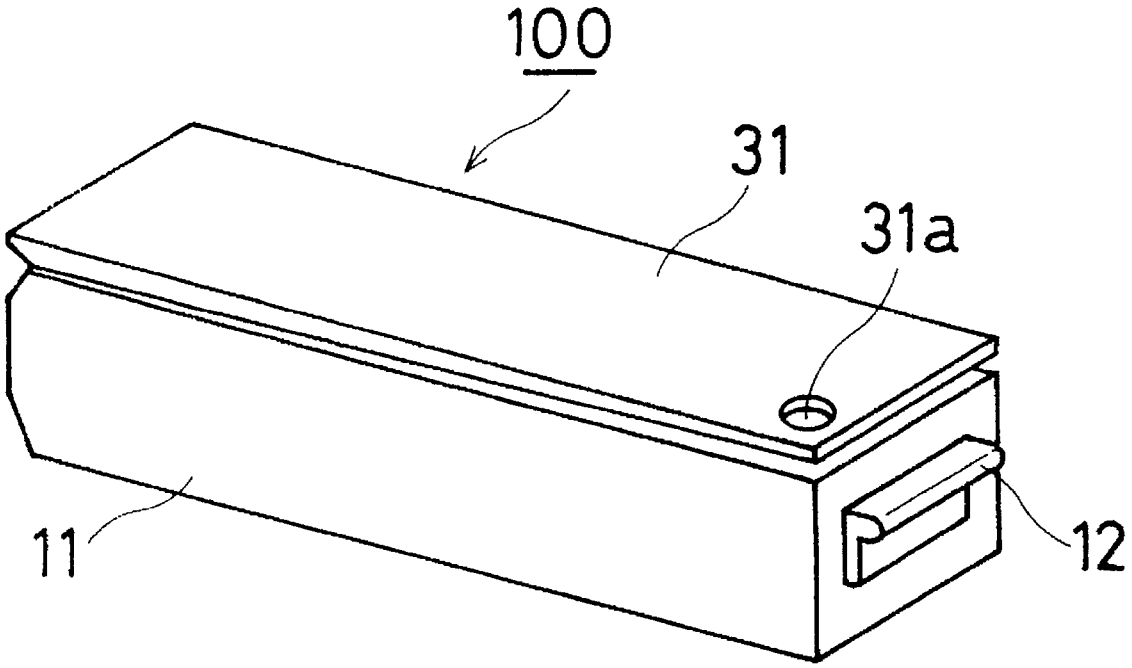
FIG. 2 is a perspective view showing a totally closed state of the cover handle of the bill receiver according to the first embodiment of the invention.
Figure 3:
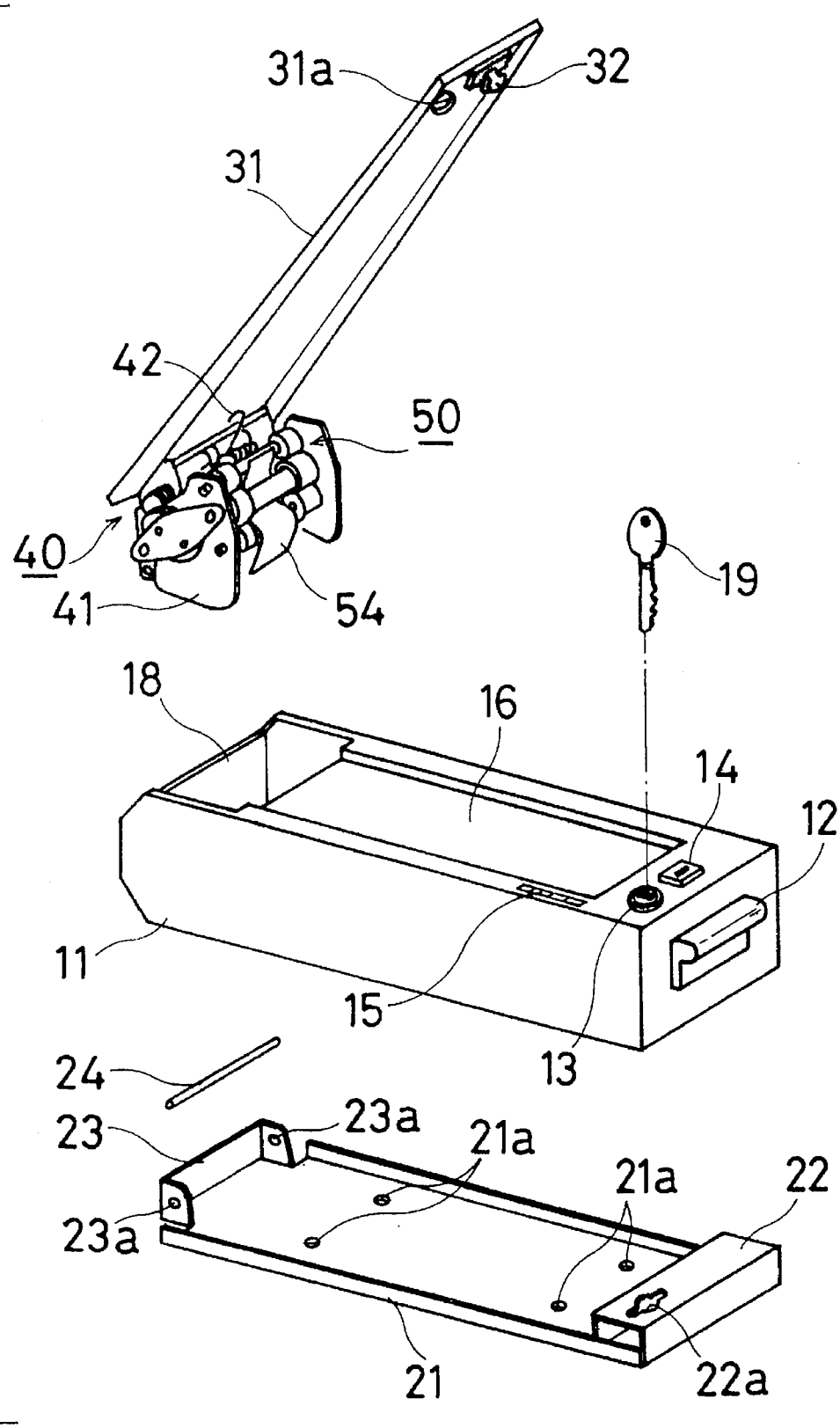
FIG. 3 is an exploded perspective view showing a main constitution of the bill receiver according to the first embodiment of the invention.
Figure 4:
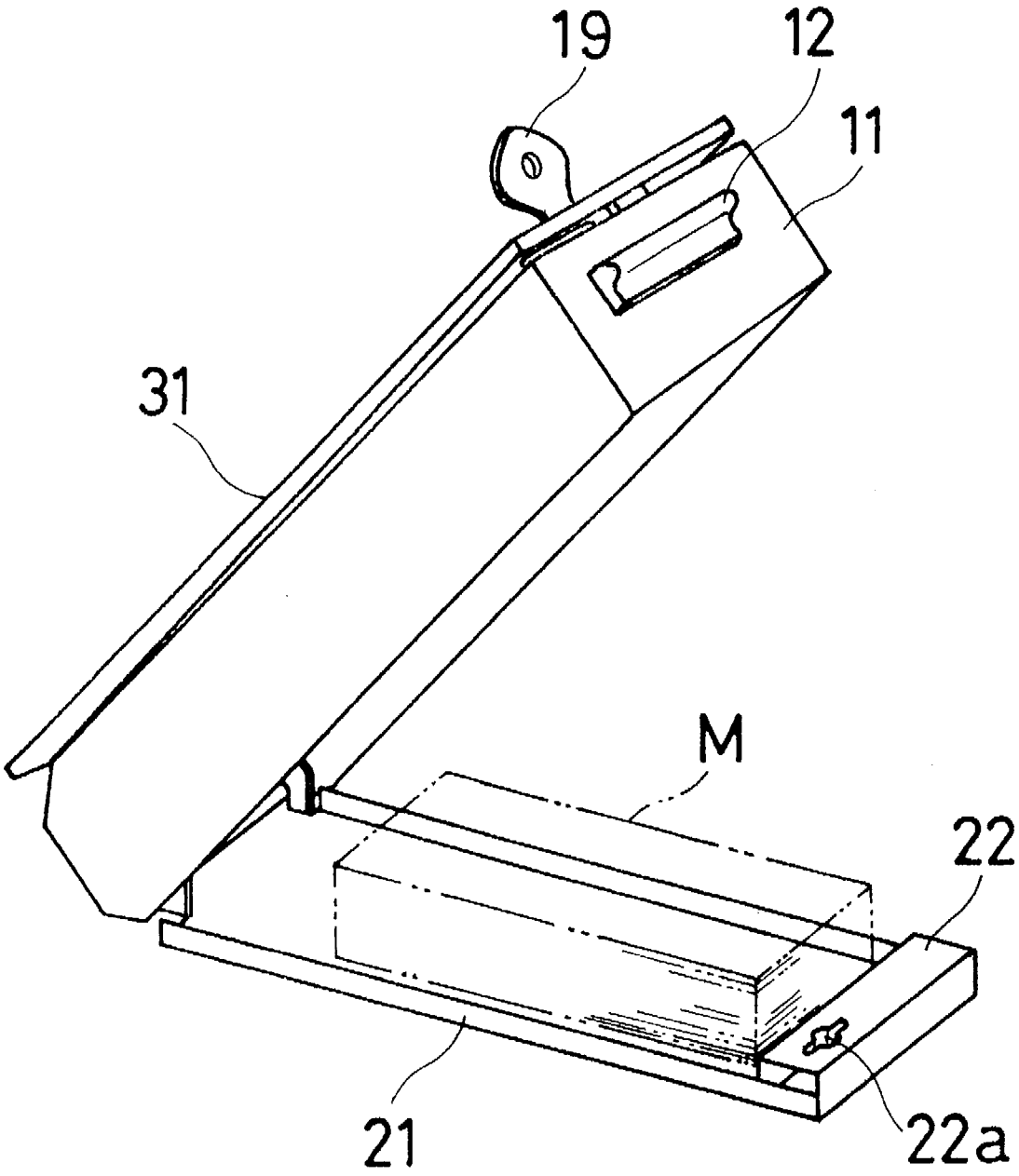
FIG. 4 is a perspective view showing a taken-out state of a bill in the bill receiver according to the first embodiment of the invention.

FIG. 1 is a perspective view showing a full open state of a cover handle of a bill receiver according to a first embodiment of the invention. FIG. 2 is a perspective view showing a totally closed state of the cover handle of the bill receiver according to the first embodiment of the invention. FIG. 3 is an exploded perspective view showing a main constitution of the bill receiver according to the first embodiment of the invention. FIG. 4 is a perspective view showing a taken-out state of a bill in the bill receiver according to the first embodiment of the invention.

Referring to FIG. 1 to FIG. 4, a casing 11 of a bill receiver 100 is formed of four side walls and a top wall to have substantially a rectangular parallelopiped box shape with a bottom opened. The casing 11 has an upper surface of the top wall dented downward to define a guide groove 16 as a guide thereon. The groove 16 has a width a little wider than that of a bill M, e.g. a Japanese ten thousand yen bill, and a length approximately equal to that of the length of the bill M. For example, the 10,000 yen bill is about 76 mm wide and 160 mm long.

A cover handle 31 as a cover is connected by a hinge to a mounting plate 41 for a speed increasing gear unit 40 as a speed increasing unit and a carrying roller unit 50 as a carrier unit, described later, so as to cover the whole upper surface of the casing 11. The mounting plate 41 is fixed on a unit supporting wall 18 of the casing 11. Thus, the cover handle 31 can be opened and closed as desired onto the upper surface of the casing 11.

A push fit latch support 14, a key main body 13 and a counter 15 are provided around the guide groove 16 on the upper surface of the casing 11. The latch support 14 serves for catching a latch claw 32, when the cover handle 31 is totally closed. The key main body 13 is used to lock the casing 11 onto a base 21. The counter 15 counts opening and closing times of the cover handle 31. The latch support 14 has a mechanism which is already known. The latch support 14 holds the cover handle 31 by catching the latch claw 32 at the first timing when the cover handle 31 is totally closed. The latch support 14 releases the latch claw 32 by pushing down the cover handle 32 at around the latch claw 32 at the next timing. When the latch claw 32 is released, the cover handle 31 jumps up to a fixed angle from the upper surface of the casing 11 by a force of a spring 42 so as to be fully opened.

As shown in FIG. 3, the base 21 as a fixed part is separately fabricated from the casing 11 and assembled to the bottom thereof, thereby forming the bottom wall of the casing 11. The base 21 is connected to the mounting plate 41 by a hinge. Namely, a hinge rod 24 is inserted through a hinge hole 23*a*, which is formed at a hinge supporting bent portion 23, and the mounting plate 41. In the illustrated embodiment, the bill receiver 100 is fixed in a drawer of a register via screws and fixing screw holes 21*a* of the base 21. The casing 11 can be manually opened and closed as desired to the base 21 by a grip 12 by a key main body 13 as a key part, a key 19 and a key lock hole 22*a* as a key part formed at a key locking bent portion 22 of the base 21. Namely, the key 19 is inserted into a keyhole of the key main body 13 to make it engaged with or released from the key lock hole 22*a*, thereby closing or opening the casing 11 to the base 21. Even if the cover handle 31 is closed, the key 19 can be inserted into the key main body 13 through a key insertion opening 31*a* provided on the cover handle 31. Thus, the casing 11 can be locked on and released from the base 21 at any time (Ref. to FIG. 4).

Figure 5:
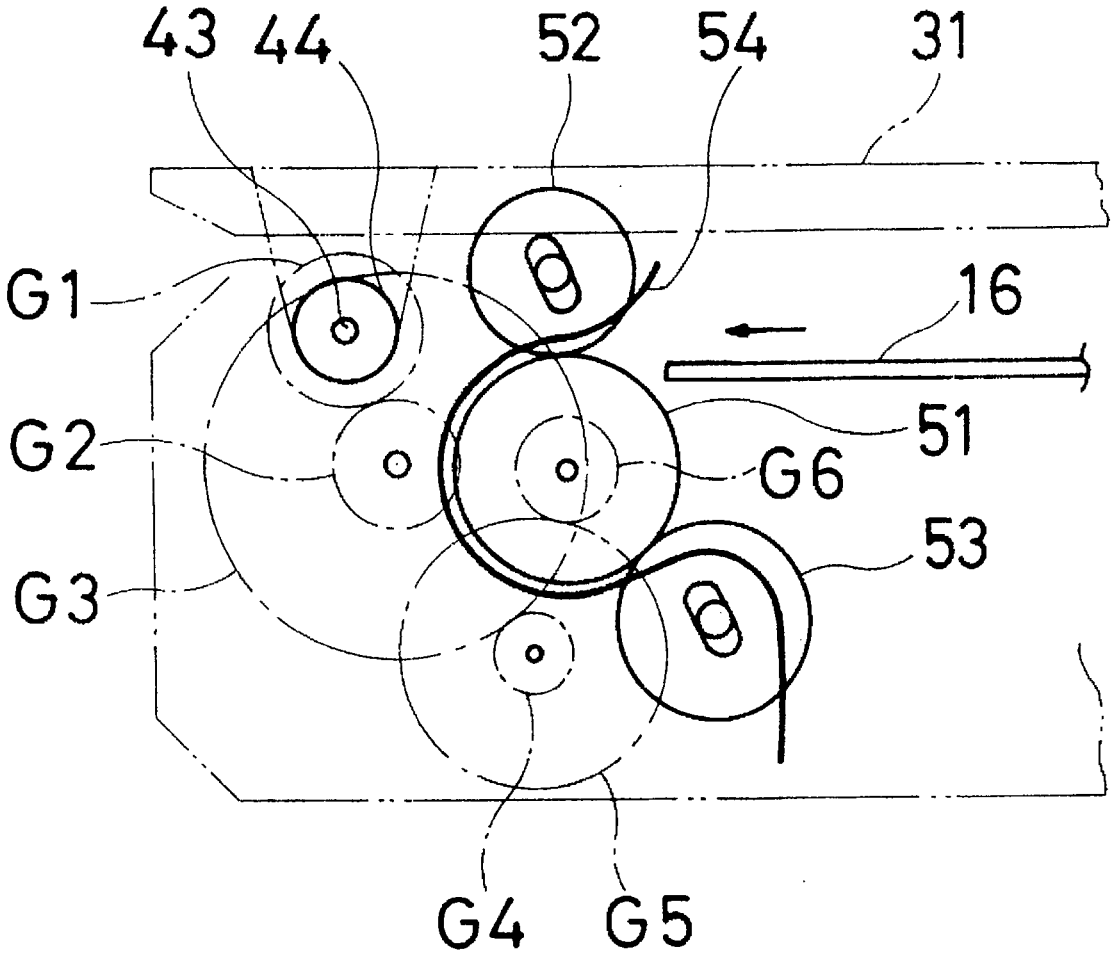
FIG. 5 is a schematic view showing a carrier unit in the bill receiver according to the first embodiment of the invention.

Next, the speed increasing gear unit 40 and the carrying roller unit 50 in the bill receiver according to the first embodiment of the invention are described referring to FIG. 5.

In FIG. 5, the speed increasing gear unit 40 is comprised of a gear train or gears G1–G6. The gear G1 is supported coaxially with the rotation shaft of the cover handle 31. Plural gear stages or gears G2–G6 are supported by shafts on the mounting plate 41 and rotated step by step through the gear G1. A torsion spring 43 as a buffering means is used as a rotation shaft of the cover handle 31 so that a force applied from the cover handle 31 is gently transmitted to the speed increasing gear unit 40 and the following stages. A conventional one way clutch 44 as a clutch means is interposed between the torsion spring 43 and the gear G1. The one way clutch 44 drivingly connects the torsion spring 43 with the gear G1 in a closing direction of the cover handle 31 while releasing linkage therebetween in an opening direction of the cover handle 31.

The carrying roller unit 50 is comprised of a drive roller 51 and following rollers 52 and 53. The drive roller 51 is secured coaxially with the last stage gear G6, and the following rollers 52 and 53 are provided over and under the drive roller 51, respectively. A guide plate 54 is arranged around an outer circumference of the drive roller 51 with a fixed clearance kept to the outer circumference of the roller 51. The guide plate 54 guides the bill M along the guide groove 16 in an arrow direction in FIG. 5, leads it inside the casing 11 and receiving it on the base 21.

Next, a series of operational steps for receiving the bill M into the bill receiver 100 of the present embodiment are described hereafter.

First of all, the bill receiver 100 of the present embodiment is fixed, e.g. in a drawer of a register. At this time, the cover handle 31 is in the totally closed state as shown in FIG. 2. Then, the latch claw 32 is released from the push fit latch support 14 by pushing down the upper surface, around the latch claw 32, of the cover handle 31. At the time, the one way clutch 44 moves in the disengaging direction so that the linkage between the torsion spring 43 and the gear G1 is released, as described above. As shown in FIG. 1, the cover handle 31 rotate up to an angle of the full open state, e.g. about 80 degrees, by the force of the spring 42. Thus, the bill receiver becomes ready for use.

In this state, the bill M is put on the guide groove 16 and moved therealong so as to meet an opening between the drive roller 51 and the guide plate 54. Here, the following roller 52 is beforehand lifted up and separated from the drive roller 51 by a member not shown, in synchronous with the movement, by an angle around the full open state, of the cover handle 31, e.g. about 10 degrees. Accordingly, the leading end of the bill M can easily meet the opening between the drive roller 51 and the guide plate 54.

Next, the cover handle 31 is pushed down from the full open state to the totally closed state. The latch claw 32 engages with the push fit latch support 14 to be held thereby. In this moving direction of the cover handle 31, the torsion spring 43 and the gear G1 is drivingly coupled through the one way clutch 44, so that the drive roller 51 is rotated through the gear stages or the gears G2–G6. If the rotation ratio between the gear G1 and the last gear G6 is set at 1:20 and the diameter of the drive roller 51 is 20 mm, a rotation of the cover handle 31 by an angle of about 63 degrees provides a carrying distance of about 220 mm (=20%×(63/360)×20) for the bill M. Here, the length of the ten thousand yen bill M is about 160 mm. Then, 220 mm minus 160 mm equals 60 mm, which approximately corresponds to a circumferential length of the drive roller 51. If the carrying distance is not less than the above, the bill M put on the guide groove 16 can be carried and drawn into the drive roller 51, thereby being moved up to the base 21 in the casing 11.

The bills M are piled up on the base 21 in the casing 11 one by one by repeating the above operation. Here, the approximate number of the accumulated bills M can be known by the counter 15 for counting the movement times of the cover handle 31.

Next, an operation after the fixed number of the bill M is received in the bill receiver 100 is described hereafter.

First, in the state of FIG. 2, the engagement between the casing 11 and the base 21 is released by inserting the key 19 into the key main body 13 through the key insertion opening 31*a* of the cover handle 31 and rotating it in a fixed direction.

Then, as shown in FIG. 4, the casing 11 can be rotatively raised from the base 21 through the hinge by holding the grip 12. Thus, the bills M piled on the base 21 can be taken out.

In this embodiment, the bill M put on the guide groove 16 is carried into the inside space between the casing 11 and the base 21 by the carrying roller unit 50 in synchronous with the movement of the opening and closing cover handle 31.

Accordingly, the transferring operation of the bill M is completed very naturally and reliably.

Moreover, if the key main body 13 is fixed in the key lock hole 22*a* of the base 21, the container box defined by the casing 11 and the base 21 becomes ready for use or storing the bills M.

The container for the bills M is mainly formed of the casing 11 of rigid parallelopiped box shape with the bottom opened, so that it can be strong and becomes small sized without doubling the walls. Moreover, when the bill M is taken out from inside of the container box after the casing 11 is opened, the bills M are piled up on the base 21 of substantially flat shape, so that it is easy to take out the bill M from the inside of the box.

Furthermore, even if the angle of one rotation of the cover handle 31 from the full opening state to the totally closed state is small, a sufficiently long carrying distance can be obtained by selecting proper gear ratios of the speed increasing gear unit 40. Accordingly, the bill receiver 100 can be set even in such a place as the opening angle of the cover handle 31 cannot be large so much.

Moreover, when the latch claw 32 releases the push fit latch support 14, the cover handle 31 easily moves to rotate from the totally closed state to the full open state by force of the spring 42. Here, the one way clutch 44 is in the disengaging state, so that the speed increasing gear unit 40 and its following stage members are drivingly disconnected from the movement of the cover handle 31. As a result, the force of the spring 42 can be used only for the movement of the cover handle 31 in the opening direction. In addition, the carrying roller unit 50 is never rotated reversely, so that there are no such disadvantages as the bills M are reversely carried.

Furthermore, even if the cover handle 31 is moved by a large force in the closing direction, the force is stored as an energizing force of the torsion spring 43 for a moment. Then, the energizing force is gradually applied to the following stages from the speed increasing gear unit 40. As a result, too much force does not applied to the speed increasing gear unit 40 and so on all at once, and it is possible to prevent their damages.

While the carrying unit in the above embodiment is made of the carrying roller unit 50 which carries the bill M by a roller mechanism, it may be made of a belt drive mechanism. It may be modified in various modes, as long as it is able to carry the bill M put on the guide groove 16 inside the container box in synchronous with the movement of the cover handle 31 from opening to closing.

While the cover handle 31 is formed so as to cover almost all of the upper surface of the casing 11 in the above embodiment, it may be formed of a member of a lever shape which covers a part of the upper surface of the casing 11. It may be modified in various ways, as long as it can carry a bill put on the guide inside the container box in synchronous with the movement from opening to closing of the cover.

While the above embodiment is concretized into the bill receiver 100 for receiving the bills M such as ten thousand yen bills and so on and keeping them in such a way as to be hardly moved, as a matter of course, it can be used for bills smaller or larger than the ten thousand yen bill, such as five thousand yen bills and one thousand yen bills, bills of other nations than Japan, and so on.

Moreover, while the bill receiver 100 in the above embodiment is fixed in the drawer of the register, it may be secured to a structure which is difficult to be carried such as a counter around the register and so on.

Figure 6:
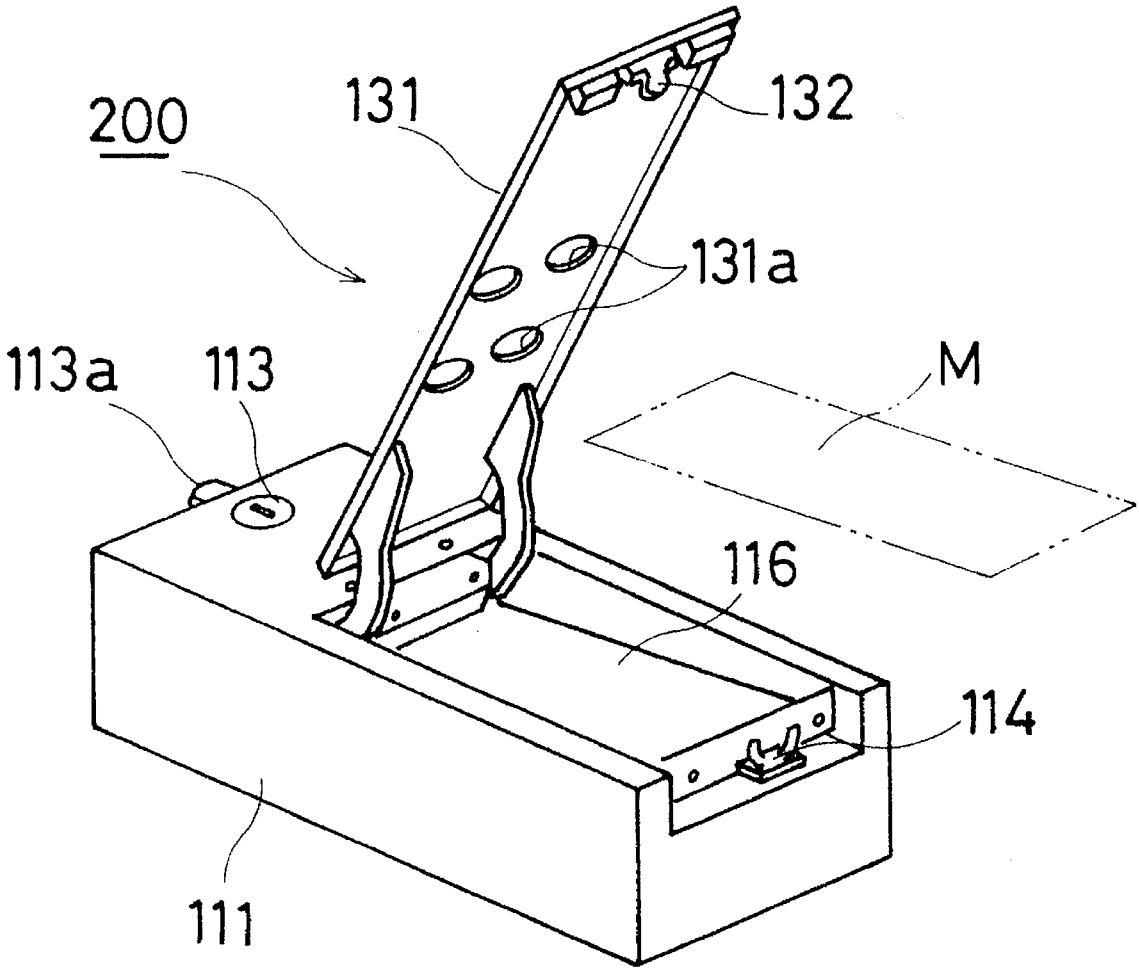
FIG. 6 is a perspective view showing a full open state of a cover handle of a bill receiver according to a second embodiment of the invention.
Figure 7:
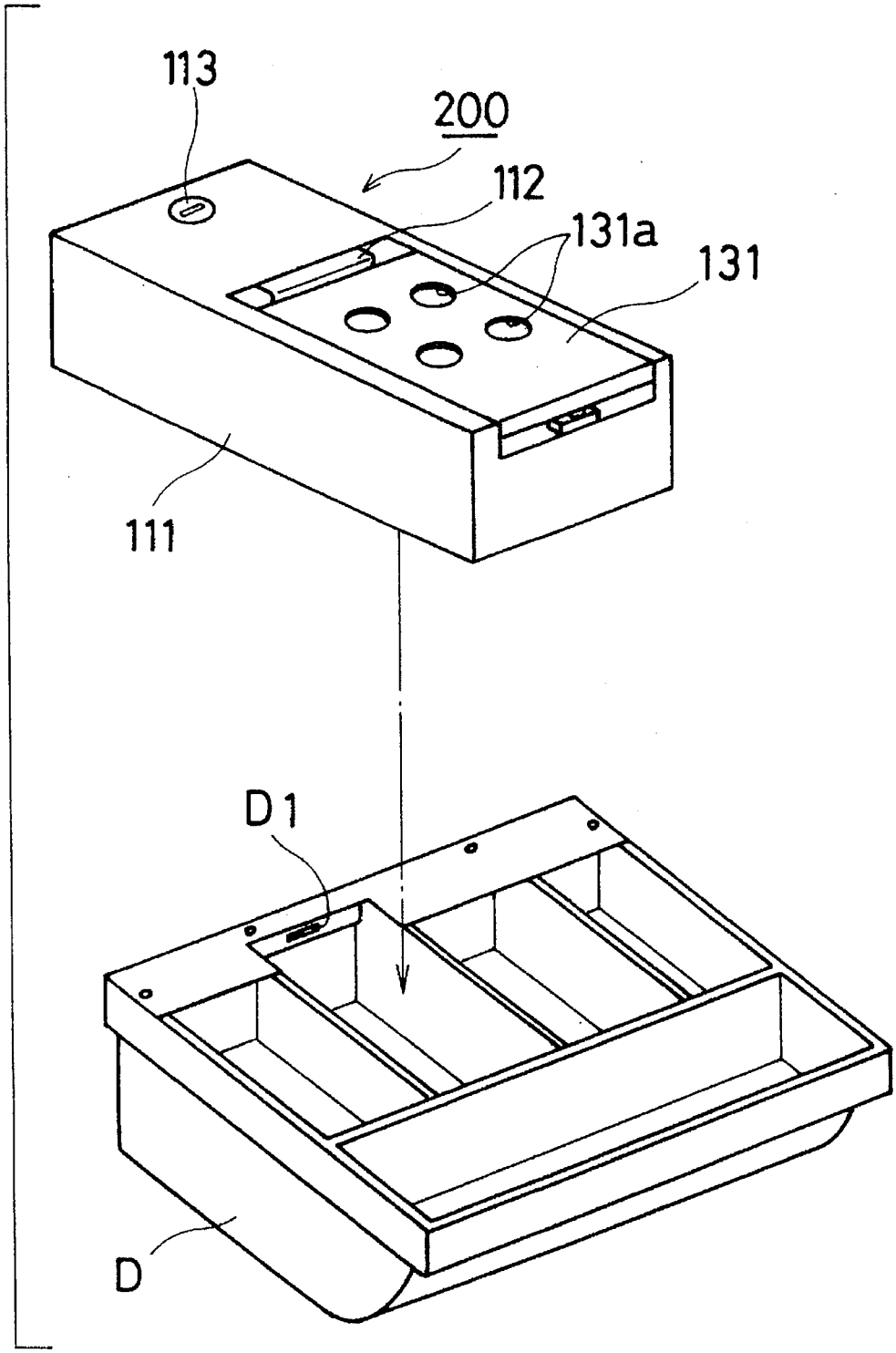
FIG. 7 is a perspective view showing a totally closed state of the cover handle of the bill receiver according to the second embodiment of the invention and showing a drawer of a register where the bill receiver is inserted and fixed.
Figure 8:
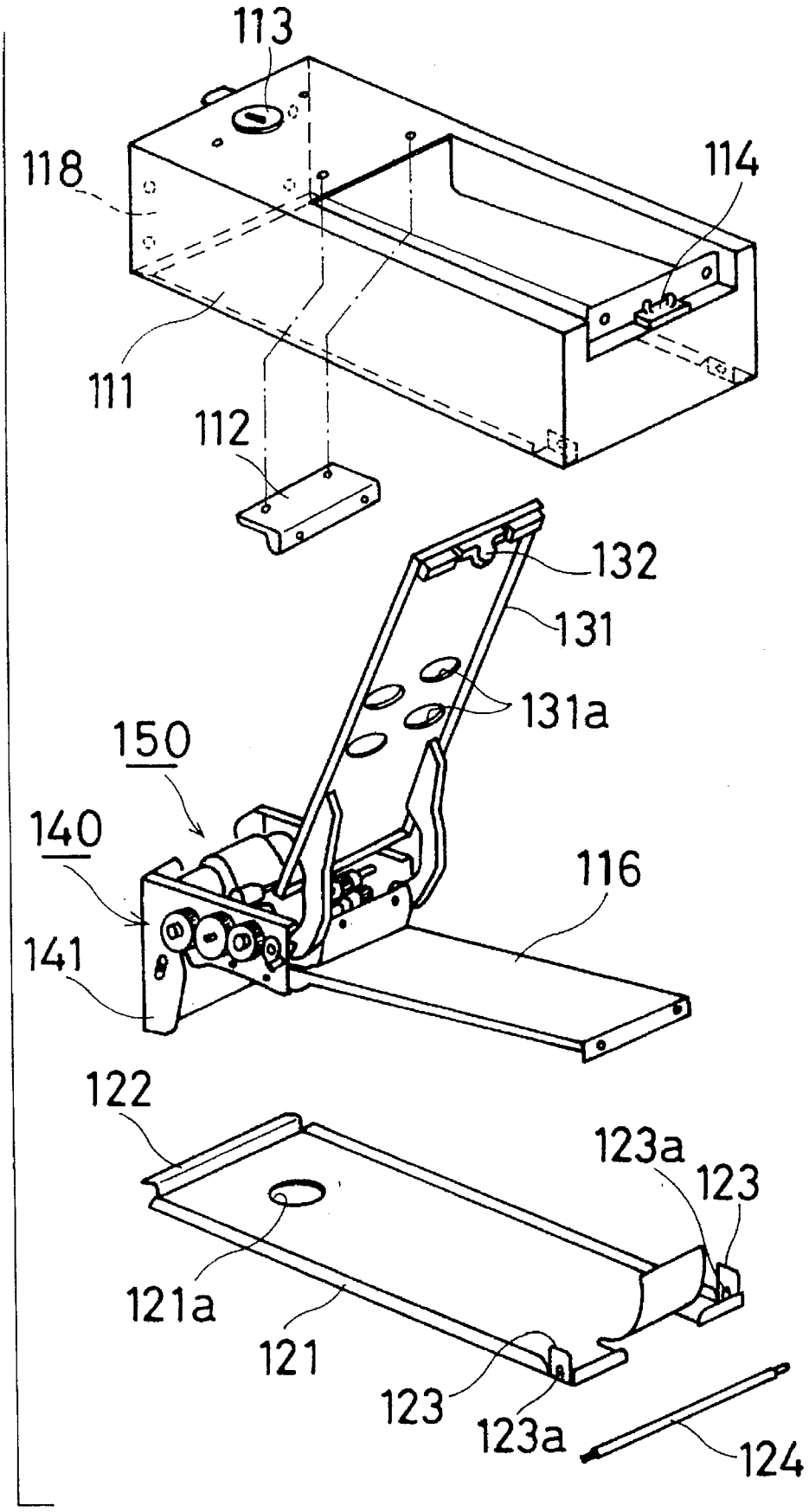
FIG. 8 is an exploded perspective view showing a main constitution of the bill receiver according to the second embodiment of the invention.
Figure 9:
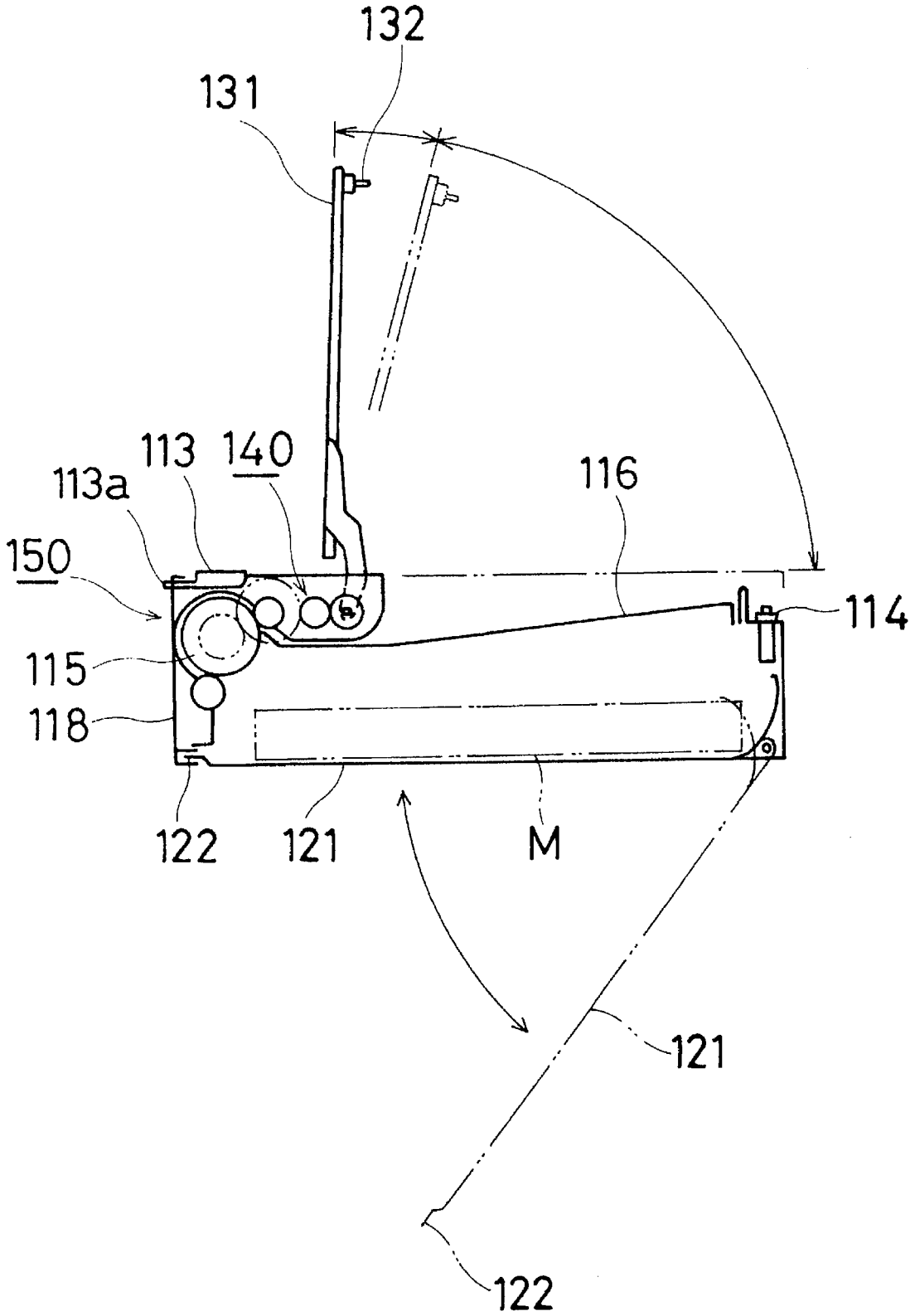
FIG. 9 is an explanatory view showing a received state and a taken-out state of a bill in the bill receiver according to the second embodiment of the invention.

FIG. 6 is a perspective view showing a full open state of a cover handle of a bill receiver according to a second embodiment of the invention. FIG. 7 is a perspective view showing a totally closed state of the cover handle of the bill receiver according to the second embodiment of the invention and showing a drawer of a register where the bill receiver is inserted and fixed. FIG. 8 is an exploded perspective view showing a main constitution of the bill receiver according to the second embodiment of the invention. FIG. 9 is an explanatory view showing a received state and a taken-out state of a bill in the bill receiver according to the second embodiment of the invention.

Referring to FIG. 6 to FIG. 9, a casing 111 of a bill receiver 200 is formed of four side walls and a top wall to have substantially a rectangular parallelopiped box shape with a bottom opened. The casing 111 has an upper surface of the top wall dented downward to define a guide groove 116 as a guide thereon. The guide groove 116 is separately fabricated and assembled to the casing 111 in this embodiment. Moreover, the casing 111 is formed in a length near the length of the bill M, e.g. 10,000 yen bill, so that the guide groove 116 has a length shorter than the length of the bill M.

A cover handle 131 as a cover is connected by a hinge to a mounting plate 141 for a speed increasing gear unit 140 as a speed increasing unit and a carrying roller unit 150 as a carrier unit, described later, so as to cover nearly two thirds of the upper surface of the casing 111. The mounting plate 141 is fixed on a unit supporting wall 118 of the casing 111. Thus, the cover handle 131 can be opened and closed as desired onto the upper surface of the casing 111.

A push fit latch support 114 and a key main body 113 are provided around the guide groove 116 on the upper surface of the casing 111. The latch support 114 serves for catching a latch claw 132, when the cover handle 131 is totally closed. The key main body 113 is used to lock the casing 111 onto a drawer described later. The latch support 114 has a mechanism which is already known. The latch support 114 holds the cover handle 131 by catching the latch claw 132 at the first timing when the cover handle 131 is totally closed. The latch support 114 releases the latch claw 132 by pushing down the cover handle 132 at around the latch claw 132 at the next timing. When the latch claw 132 is released, the cover handle 131 Jumps up to a fixed angle from the upper surface of the casing 111 by a force of a spring so as to be fully opened.

As shown in FIG. 8, the base 121 as a fixed part is separately fabricated from the casing 111 and assembled to the bottom thereof, thereby forming the bottom wall of the casing 111. The base 121 is connected to the mounting plate 141 by a hinge. Namely, a hinge rod 124 is inserted through a hinge hole 123*a*, which is formed at a hinge supporting bent portion 123, and the mounting plate 141. The base 121 is surely held on the casing 111 while a leading end 122 hooked thereon. In the illustrated embodiment of the bill receiver 200, the casing 111 is fitted inside a fixed division of the drawer D of the register, while a side projection 113*a* of the key main body 113 is locked in a key locking hole D1 provided on the drawer D through a key not shown, thereby securing the casing 111 in the drawer D. The base 121 has a round hole 121*a* of such a dimension as to enable a finger to be inserted. A user can hang the leading end 122 of the base 121 on the bottom edge at one longitudinal end of the casing 111 via the round hole 121*a*, thereby fixing the base 121 on the casing 111 (see FIG. 9).

Figure 10:
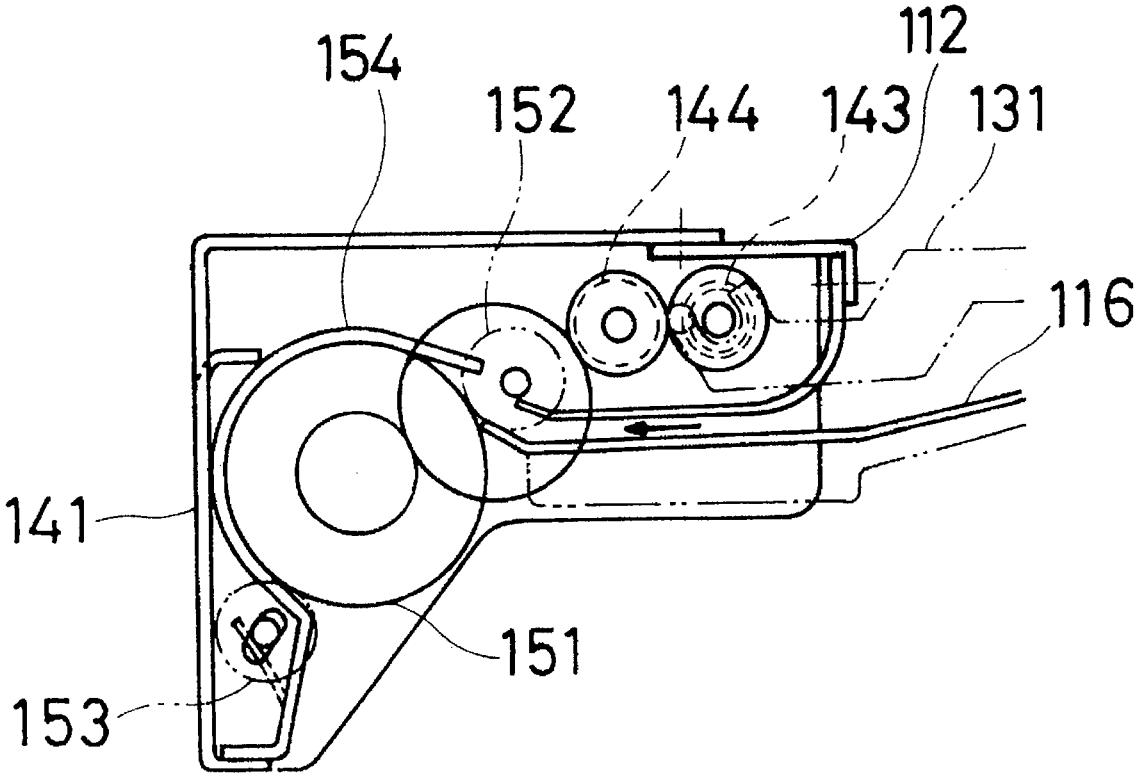
FIG. 10 is a schematic view showing a carrier unit in the bill receiver according to the second embodiment of the invention.

Next, the speed increasing gear unit 140 and the carrying roller unit 150 in the bill receiver according to the second embodiment of the invention are described referring to FIG. 10.

In FIG. 10, the speed increasing gear unit 40 is comprised of a gear train. A drive gear is supported coaxially with the rotation shaft of the cover handle 131. Plural gear stages or following gears are supported by shafts on the mounting plate 141 and rotated step by step through the drive gear. A torsion spring 143 as a buffering means is coaxially wound around a rotation shaft of the cover handle 131 so that a force applied from the cover handle 131 is gently transmitted to the speed increasing gear unit 140 composed of a well-known speed increasing gear unit. A conventional one way clutch 144 as a clutch means is interposed between the torsion spring 143 and the gear train. The one way clutch 144 drivingly connects the torsion spring 143 with the gear train in a closing direction of the cover handle 131 while releasing linkage therebetween in an opening direction of the cover handle 131.

The carrying roller unit 150 is comprised of a drive roller 151 and following rollers 152 and 153. The drive roller 151 is secured coaxially with the last stage gear, and the following rollers 152 and 153 are provided over and under the drive roller 151, respectively. The drive roller 151 accommodates therein the speed increasing gear unit as a final stage gear of the above gear stages so as to obtain a predetermined gear ratio. A guide plate 154 is arranged around an outer circumference of the drive roller 151 with a fixed clearance kept to the outer circumference of the roller 151. The guide plate 154 guides the bill M along the guide groove 116 in an arrow direction in FIG. 10, leads it inside the casing 111 and receiving it on the base 121.

Next, a series of operational steps for receiving the bill M into the bill receiver 200 of the present embodiment are described hereafter.

First, the present embodiment of the bill receiver 200 is secured inside the drawer D of the register.

The cover handle 131 is in the totally closed state as shown in FIG. 7. Then, the latch claw 132 is released from the push fit latch support 114 by pushing down the upper surface, around the latch claw 132, of the cover handle 131. At the time, the one way clutch 144 moves in the disengaging direction so that the linkage between the torsion spring 143 and the gear train is released, as described above. As shown in FIG. 6, the cover handle 131 rotate up to an angle of the full open state, e.g. about 90 degrees, by the force of the spring not shown. Thus, the bill receiver becomes ready for use.

In this state, the bill M is put on the guide groove 116 and moved therealong so as to meet an opening between the drive roller 151 and the guide plate 154. Here, the following roller 152 is beforehand lifted up and separated from the drive roller 151 by a member not shown, in synchronous with the movement, by an angle around the full open state, of the cover handle 131, e.g. about 10 degrees. Accordingly, the leading end of the bill M can easily meet the opening between the drive roller 151 and the guide plate 154.

Next, the cover handle 131 Is pushed down from the full open state to the totally closed state. The latch claw 132 engages with the push fit latch support 114 to be held thereby. In this moving direction of the cover handle 131, the torsion spring 143 and the gear train is drivingly coupled through the one way clutch 144, so that the drive roller 151 is rotated through the gear stages and the speed increasing gear unit.

In case of providing a similar degree of a carrying distance by the drive roller 151 to the above first embodiment, the bill M put on the guide groove 116 can be carried and drawn into the drive roller 151, thereby being moved up to the base 121 in the casing 111.

The bills M are piled up on the base 121 in the casing 111 one by one by repeating the above operation.

Next, an operation after the fixed number of the bill M is received in the bill receiver 200 is described hereafter.

First, in the state of FIG. 7, the engagement between the casing 111 and the key locking hole D1 of he drawer D is released by inserting a proper key into the key main body 113 of the casing 111 and rotating it in a fixed direction. Then, the casing 111 is lifted from the drawer D in the reverse direction to the inserting direction shown in FIG. 7. Thereafter, the leading end 122 of the base 121 shown in FIG. 9 is released from the lower end of the unit mounting wall 118. Thus, the bills M piled on the base 121 can be taken out.

In this embodiment, the bill M put on the guide groove 116 is carried into the inside space between the casing 111 and the base 121 by the carrying roller unit 150 in synchronous with the movement of the opening and closing cover handle 131.

Accordingly, the transferring operation of the bill M is completed very naturally and reliably.

While the casing 111 is secured on the drawer D as the predetermined fixed part by the key main body 113, it may be fixed on another fixed part than the drawer D by the key main body 113.

Namely, the casing 111 can be easily separated from the fixed part via the key main body 113, so that the bills M are easy to be taken out.

Moreover, if the key main body 113 is fixed on the drawer D, the container box defined by the casing 111 and the base 121 becomes ready for use or storing the bills M.

The container for the bills M is mainly formed of the casing 111 of rigid parallelopiped box shape with the bottom opened, so that it can be strong and becomes small sized without doubling the walls. Moreover, when the bill M is taken out from inside of the container box after the casing 111 is opened, the bills M are piled up on the base 121 of substantially flat shape, so that it is easy to take out the bill M from the inside of the box.

Furthermore, a sufficiently long carrying distance can be obtained with one operation from opening to closing of the cover handle 131 by selecting proper gear ratios of the speed increasing gear unit 140. Accordingly, the bill receiver 200 can be set even in such a place as the opening angle of the cover handle 131 cannot be large so much.

Moreover, when the latch claw 132 releases the push fit latch support 114, the cover handle 31 easily moves to rotate from the totally closed state to the full open state by force of the spring. Here, the one way clutch 144 is in the disengaging state, so that the speed increasing gear unit 140 and its following stage members are drivingly disconnected from the movement of the cover handle 131. As a result, the force of the spring can be used only for the movement of the cover handle 131 in the opening direction. In addition, the carrying roller unit 150 is never rotated reversely, so that there are no such disadvantages as the bills M are reversely carried.

Furthermore, even if the cover handle 131 is moved by a large force in the closing direction, the force is stored as an energizing force of the torsion spring 143 for a moment. Then, the energizing force is gradually applied to the following stages from the speed increasing gear unit 140. As a result, too much force does not applied to the speed increasing gear unit 140 and so on all at once, and it is possible to prevent their damages.

While the carrying unit in the above embodiment is made of the carrying roller unit 150 which carries the bill M by a roller mechanism, it may be made of a belt drive mechanism. It may be modified in various modes, as long as it is able to carry the bill M put on the guide groove 116 inside the container box in synchronous with the movement of the cover handle 131 from opening to closing.

While the cover handle 131 is formed so as to cover about two thirds of the upper surface of the casing 111 in the above embodiment, it may be formed of a member of a lever shape which covers a part of the upper surface of the casing 111. It may be modified in various ways, as long as it can carry a bill put on the guide inside the container box in synchronous with the movement from opening to closing of the cover.

While the above embodiment is concretized into the bill receiver 100 for receiving the bills M such as ten thousand yen bills and so on and keeping them in such a way as to be hardly moved, as a matter of course, it can be used for bills smaller or larger than the ten thousand yen bill, such as five thousand yen bills and one thousand yen bills, bills of other nations than Japan, and so on.

While the casing 111 is secured to the drawer D as the fixed part via the key main body 113, it may be fixed on a table for mounting the register or other any places than the register. Preferably, the fixed part is rigidly provided or have an enough weight. This has advantages that the bill register is not easily moved.

While the above embodiment is concretized into the bill receiver 200 for receiving the bills M such as ten thousand yen bills and so on and keeping them in such a way as to be hardly moved, as a matter of course, it can be used for bills smaller or larger than the ten thousand yen bill, such as five thousand yen bills and one thousand yen bills, bills of other nations than Japan, and so on.

The preferred embodiments described herein are therefor illustrative and not restrictive, the scope of the invention being indicated in the appended claims and al variations which come within the meaning of the claims are intended to be embraced therein.

What is claimed is:

1. A bill receiver comprising:

a casing defining a container box for receiving and storing bills;

a guide provided on an upper surface of the casing and guiding lateral edges of the bill;

a cover provided on the upper surface of the casing so as to open and close the upper surface of the casing; and means for transferring the bill on the guide inside the container box in synchronous with an operation of the cover from an open state to a closed state.

2. A bill receiver according to claim 1, further comprising a lock means for locking and releasing the casing on and from a fixed part.

3. A bill receiver according to claim 1, in which the transferring means including a speed increasing unit that finishes transferring and storing the bill inside the box in accordance with one operation from a full open state to a totally closed state of the cover.

4. A bill receiver according to claim 1, in which the transferring means including a clutch means for releasing coupling between the cover and a following stage when the cover is opened.

5. A bill receiver according to claim 1, in which the transferring means including a buffering means for buffering a force applied from the cover for transmission to a following stage when the cover is closed.

6. A bill receiver comprising:

a box made of outer walls for receiving and storing bills, the box including;

a base defining one part of the outer walls at least at a bottom of the box, and a casing defining an other part of the outer walls than the base, while containing a top of the outer walls;

a key part for securing the casing on a predetermined fixed part;

a guide provided on the top surface of the casing and guiding lateral edges of the bill;

a cover provided on the top surface of the casing so as to open and close the .top surface of the casing; and means for transferring the bill on the guide inside the box in synchronous with an operation of the cover from an open state to a closed state.

7. A bill receiver according to claim 6, in which the transferring means including a speed increasing unit that finishes transferring and storing the bill inside the box in accordance with one operation from a full open state to a totally closed state of the cover.

8. A bill receiver according to claim 6, in which the transferring means including a clutch means for releasing coupling between the cover and a following stage when the cover is opened.

9. A bill receiver according to claim 6, in which the transferring means including a buffering means for buffering a force applied from the cover for transmission to a following stage when the cover is closed.

* * * * *